US005524595A

United States Patent [19]

Ito

[11] Patent Number: 5,524,595

[45] Date of Patent: Jun. 11, 1996

[54] EVAPORATING FUEL CONTROL SYSTEM

[75] Inventor: Takenori Ito, Kawasaki, Japan

[73] Assignee: Fuji Jukogyo Kabushiki Kaisha, Tokyo, Japan

[21] Appl. No.: 499,688

[22] Filed: Jul. 7, 1995

[30] Foreign Application Priority Data

Jul. 20, 1994 [JP] Japan ..... 6-167893

[51] Int. Cl.[6] ..... F02M 37/04

[52] U.S. Cl. ..... 123/520; 123/518

[58] Field of Search ..... 123/518, 519, 123/520, 516, 198 D, 521, 494

[56] References Cited

U.S. PATENT DOCUMENTS

| | | | |
|---|---|---|---|
| 5,245,973 | 9/1993 | Otsuka | 123/518 |
| 5,259,353 | 11/1993 | Nakai | 123/518 |
| 5,267,547 | 12/1993 | Chikamatsu | 123/518 |
| 5,408,866 | 4/1995 | Kawamura | 123/516 |
| 5,460,141 | 10/1995 | Denz | 123/520 |
| 5,479,905 | 1/1996 | Ito | 123/520 |

*Primary Examiner*—Carl S. Miller

*Attorney, Agent, or Firm*—Beveridge, DeGrandi, Weilacher & Young

[57] ABSTRACT

An evaporating fuel control system includes a fuel tank, a pressure sensor for detecting a pressure in an upper space of the tank, a learning discrimination element for discriminating as to whether a zero point correction of the pressure sensor is once performed or not at all, a learning condition determination element for determining as to whether or not a learning condition is established in the case where the pressure of the tank is near the atmospheric pressure while a vehicle is normally running under the condition that the zero point correction is not performed at all, an air pressure return element for causing the upper space in the fuel tank forcibly to be a negative pressure by a negative pressure during a purging and for thereafter opening the fuel tank to the air, a zero point set element for setting an output value of the pressure sensor to the zero point after a predetermined time after opening the tank to the atmosphere, and correction means for correcting the output value of the pressure sensor by the zero point, thereby rapidly and certainly causing the fuel tank to be the atmospheric pressure at an initial correction or at the second time correction so as to improve an accuracy of the zero point correction of the pressure sensor.

4 Claims, 9 Drawing Sheets

EVAPORATING FUEL CONTROL SYSTEM

BACKGROUND OF THE INVENTION

This invention relates to a system for controlling processing of an evaporated fuel occurring in a fuel tank in a vehicle such as an automobile, and more specifically, to an evaporated fuel control system using a learning control of a zero-point correction of a pressure sensor which detects an inner pressure in the fuel tank.

The control system generally prevents an air pollution caused by an emission of the evaporated fuel to an air in the manner that a canister once soaks the evaporated fuel occurring in an upper space of the fuel tank during stopping and running of the vehicle through an evaporation pipe, and the soaked fuel evaporated is purged through a purge pipe to an intake manifold to be burned while an engine is driven. Occurrence of the evaporated fuel changes in dependency on variable conditions such as an atmospheric temperature, an atmospheric pressure, a quantity and a temperature of fuel. And also an inner pressure in the fuel tank changes in dependency on conditions of the evaporated fuel at an initial and a purge states. Accordingly, an extremely high pressure occurs in the fuel tank and the evaporated fuel bursts out to the air at refueling when a large amount of the evaporated fuel occurs. But the fuel vapor can not fully purged while driving in a traffic congestion. In contrast, an over-negative pressure in the fuel tank causes the tank to be destroyed when a small amount of the evaporated fuel occurs and is continuously purged even though the fuel is cool.

Therefore, a pressure sensor is installed in the fuel tank to detect an inner pressure in order to prevent a trouble caused by the extremely-high or over-negative pressure in the fuel tank, thereby performing a reversion control to the inner pressure in the fuel tank to usually set to be the air pressure. An accuracy of the return-to-normal control by the pressure sensor is influenced by the changes of a sensor output due to an accuracy when produced and an aging of parts of the sensor. Accordingly, it is required that an output value from the sensor is corrected to be zero and further to perform a learning control causing a zero point to be proper in order to improve the detection accuracy of an internal pressure of the tank.

Hitherto, a prior art is disclosed in the official gazette of Japanese patent application laid-open No. 5-195896 (1993) with respect to a zero-point correction of the pressure sensor in the fuel tank. In this prior art, a second control valve of a purge pipe is closed and a first control valve in an evaporated pipe and a third control valve in an intake port of a canister are open when an engine is in condition of a cold start. At this time, internal pressure detection means detects an internal pressure value as a positive and negative pressure change point to be stored, and an output value of the internal pressure detection means is corrected in dependency on the positive and negative pressure change point.

Since the above prior art relates to a method in which the fuel tank is open to the air by closing the second control valve of the purge pipe and by opening the first control valve and the third control valve of the intake port of the canister, the internal pressure decreases step by step by soaking the evaporated fuel when the internal pressure in the fuel tank is high in dependency on an occurrence of the evaporated fuel. A time until the pressure in the fuel tank becomes an atmospheric pressure differs according to characteristics of the fuel. Furthermore, it is impossible to purge the evaporated fuel from the fuel tank during this time. Accordingly, it is difficult to cause the fuel tank to be usually the atmospheric pressure within a predetermined time, thereby disabling a proper zero-point correction. Furthermore, since the zero-point correction is performed at only a cold start of the engine, it is impossible to correspond the case where an output of the sensor changes after starting an engine.

SUMMARY OF THE INVENTION

In view of the above-mentioned condition, an object of the present invention is to improve a zero-point correction accuracy of the pressure sensor by causing the fuel tank to be an atmospheric pressure rapidly and properly at an initial time or after second time with respect to a zero-point correction of the pressure sensor.

In order to achieve the above object, an evaporating fuel control system according to a first aspect of the present invention, as shown in FIG. 1, has a fuel tank (13), a pressure sensor for detecting a pressure in an upper space of the fuel tank, a canister (22) for soaking an evaporated fuel occurring in the fuel tank, purge means for purging the evaporated fuel soaked by the canister to an engine intake system during an engine driving, learning discrimination means (C1) for discriminating as to whether or not a zero-point correction of the pressure sensor is performed at least one time, learning condition determining means (C2) for determining an establishment of a learning condition in which the pressure is near the atmospheric pressure and a vehicle is normally running after starting an engine during a purge when the zero-point correction of the pressure sensor is inoperative at least one time, air pressure returning means (C3) for causing the upper space of the fuel tank to be a negative pressure by using a negative pressure during a purge and thereafter for opening the negative pressure to the air, zero point setting means (C4) for setting an output value of the pressure sensor to a zero point after a predetermined time after opening to the air, and correction means (C5) for correcting the output value of the pressure sensor in dependency on the zero point.

The evaporating fuel control means according to a second aspect comprises a pressure sensor for detecting a pressure in an upper space of a fuel tank, a canister for soaking the evaporated fuel occurring in the fuel tank, purge means for purging the evaporated fuel soaked by the canister to an intake system of an engine while the engine is driven, learning discrimination means for discriminating as to whether or not a zero point correction of the pressure sensor is twice after an initial correction is performed, learning condition determination means for determining an establishment of a learning condition when the fuel tank satisfies a condition to be a negative pressure by repeating a plurality of processing to be negative pressure within a predetermined time in the case of the correction after two times, air pressure returning means for opening the upper space of the fuel tank to the air when the learning condition is established, zero point setting means for renewing a previous zero point by the output value of the pressure sensor after a predetermined time after opening the fuel space to the air, and correction means for correcting the output value of the pressure sensor by a renewed zero point.

The evaporating fuel control means according to a third aspect comprises atmospheric pressure returning means for causing the fuel tank to be a negative pressure by opening a pressure control valve installed in an evaporation pipe connecting the fuel tank with the canister under a condition of opening a purge control valve installed in a purge pipe connecting the canister with an intake system, and thereafter for introducing an air from the canister to the fuel tank by fully closing the purge control valve, thereby returning the pressure in the tank to substantially the atmospheric pressure after the predetermined time.

Accordingly, in the system according to the first aspect, the evaporated fuel occurring in the fuel tank is purged to the engine intake system through the canister, the pressure sensor detects the pressure in the tank at this time, and the fuel tank is controlled to be usually kept to be near the atmospheric pressure. In this case, the learning condition determination means determines the establishment of the learning condition while the vehicle is normally running after starting the engine, when the pressure in the tank is near the atmospheric pressure, and during purging the tank, if the learning discrimination means discriminates that the zero point correction of the pressure sensor is not performed at all. The air pressure returning means causes the fuel tank to be a negative pressure forcibly by the negative pressure during purging, and keeps the tank to open at the atmospheric pressure. Therefore, the air is rapidly introduced in the fuel tank which is once the negative pressure, and the fuel tank is rapidly and properly to be substantially the air pressure after the predetermined time. The zero point setting means properly sets the zero point by using the output value of the pressure sensor in this case. Since the correction means corrects the output value of the pressure sensor by the zero point, it is possible to increase the detection accuracy of the pressure in the fuel tank even if there is an inaccuracy of the parts in the pressure sensor.

In the system according to the second aspect, the evaporated fuel occurring in the fuel tank is purged to the engine intake system through the canister, the pressure sensor detects the pressure in the fuel tank, and the fuel tank is controlled to keep the pressure near the atmospheric pressure. In this case, the fuel tank is repeatedly caused to be a negative at a plurality of times within a predetermined time periods when the learning discrimination means determines the zero point correction of or after the second chance after the initial correction of the pressure sensor, and the learning condition determination means determines the establishment of the learning condition when there are much frequencies of a negative pressure in the fuel tank. Then, the air pressure return means opens the fuel tank to the air and keeps this condition in a predetermined time to introduce the air into the fuel tank by the negative pressure, thereby resulting the fuel tank to properly and rapidly be substantially the atmospheric pressure after the predetermined time. The zero point setting means learns a higher accuracy of the zero point to correct the previous zero point by using the output value of the pressure sensor at this time. The correction means corrects the output value of the pressure sensor in dependency on the corrected zero point, thereby resulting a higher detection accuracy of the pressure in the fuel tank.

In the system according to the third aspect, the air pressure returning means opens the pressure control valve in the evaporation pipe when the purge control valve in the purge pipe is opened, thereby causing the fuel tank forcibly and properly to be a negative pressure by using the negative pressure while purging. Then, the air is introduced into the fuel tank to fully close the purge control valve through the canister and the pressure control valve, thereby properly returning the pressure in the fuel tank substantially to be the atmospheric pressure after the predetermined time. Furthermore, the entire system can be simplified by using of an evaporated fuel processing control system.

As mentioned above, in the system according to the first aspect, the air pressure return means causes the upper space in the fuel tank to forcibly be a negative pressure and thereafter to be controlled to open the tank to the air when no zero point correction of the pressure sensor has been performed. Accordingly, the air can be rapidly introduced into the fuel tank by the negative pressure, and the pressure in the tank can be rapidly and properly caused substantially to be the atmospheric pressure after the predetermined time. Therefore, the zero point set means can correct the zero point in high accuracy by using the output value of the pressure sensor at this time, thereby improving the detecting accuracy of the pressure in the fuel tank even if there is the inaccuracy in the parts of the pressure sensor. The learning condition determination means determines the start of the learning control of the pressure in the fuel tank to be the atmospheric pressure while purging by learning control, thereby causing the fuel tank to effectively be a negative pressure by using the negative pressure during purging. Furthermore, a control operation does not influence the control for returning the pressure in the fuel tank.

In the system according to the second aspect, the zero point setting means controls the zero point in dependency on a correction and renewal of the previous zero point by learning a zero point correction on or after the second correction, thereby improving further the accuracy of the zero point and corresponding to an output change of the pressure sensor while the vehicle is running. In the control after the second times, the learning condition discrimination means determines the establishment of the learning condition when the fuel tank is caused to repeatedly be the negative pressure several times within the predetermined time period, thereby properly determining the condition in which there are many occurrence times of the negative pressure in the fuel tank. The air pressure returning means opens the upper space in the fuel tank to the air when the learning condition is established, thereby performing the zero point correction with a high accuracy by causing the fuel tank rapidly and properly to be the atmospheric pressure in this case.

In the system according to the third aspect, the air pressure returning means forcibly causes the fuel tank to be the negative pressure by opening the purge control valve and the pressure control valve, and thereafter the purge control valve to be fully closed to introduce the air through the canister to the fuel tank, thereby properly causing the fuel tank to be the negative pressure thereafter to return the pressure in the tank to the atmospheric pressure. Furthermore, since the system uses the evaporated fuel processing control system, it is possible to simplify the control system.

DETAILED DESCRIPTION OF THE PREFERRED EMBODIMENT

A preferred embodiment of the present invention will become understood from the following detailed description referring to the accompanying drawings.

Figure 1:
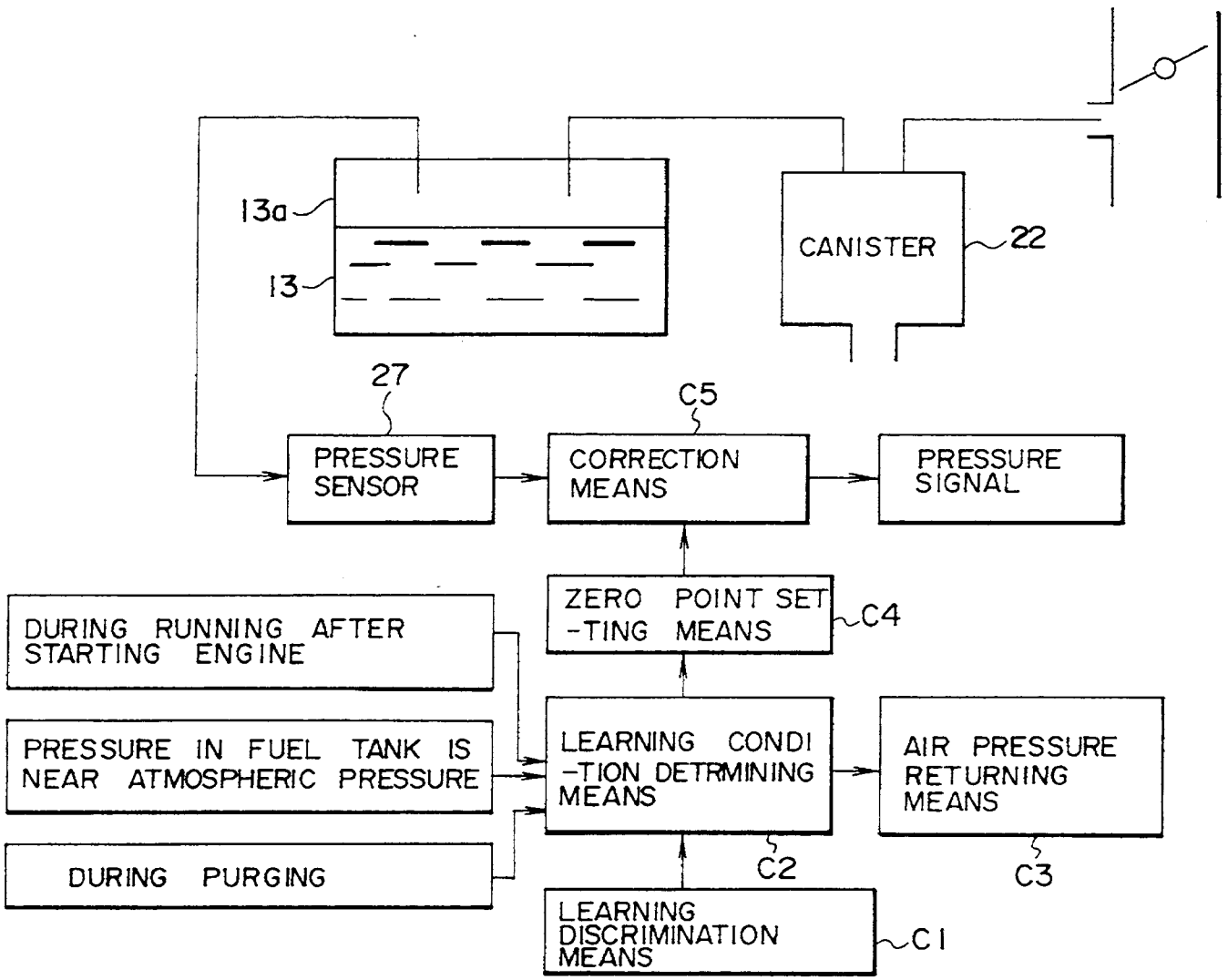
FIG. 1 is a claim corresponding diagram showing an evaporated fuel processing control system according to the present invention.
Figure 2:
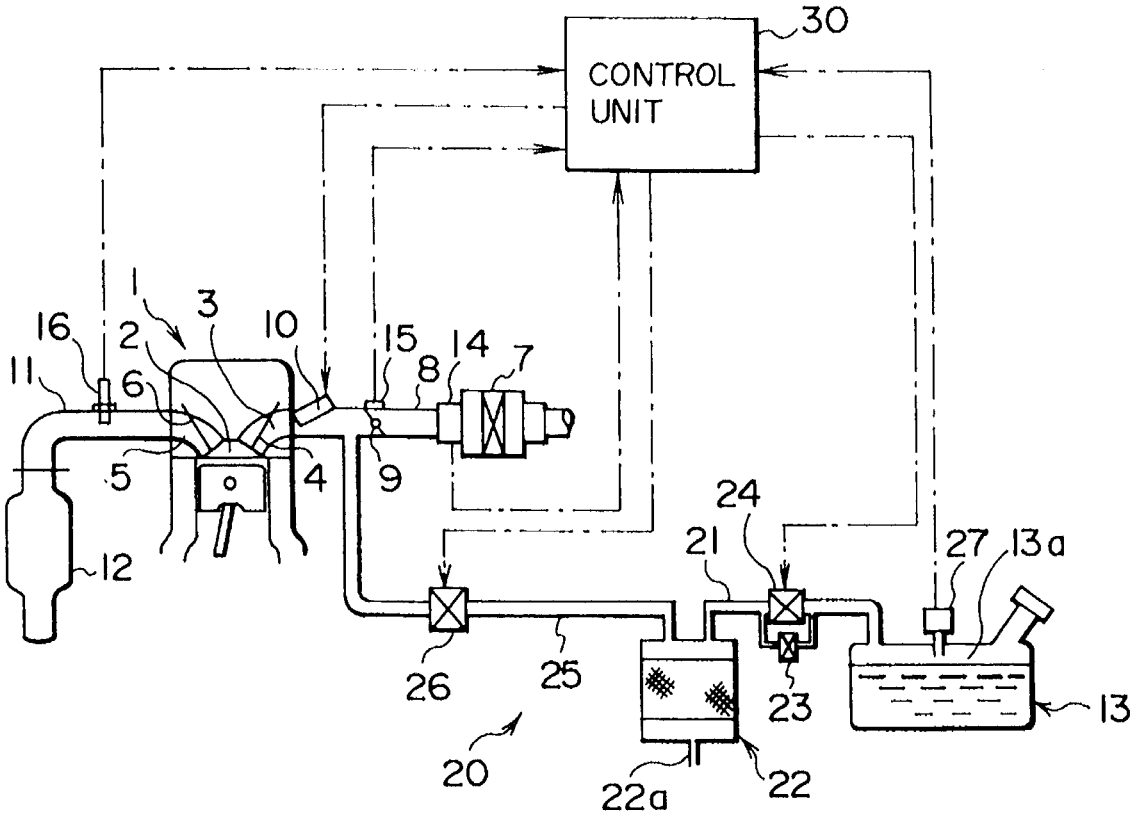
FIG. 2 is an explaining diagram showing an entire engine with the evaporated fuel processing control system.

FIG. 2 shows a schematic configuration of the evaporated fuel processing control system and an engine. In the figure, an engine 1 comprises a combustion chamber having an intake port 3 and an exhaust port 5, an intake valve 4 installed in the intake port 3, an exhaust valve 6 installed in the exhaust port 5, an air cleaner 7, an intake pipe 8 connected with the intake port 3 and having a throttle valve 9, and an injector 10 installed at an immediately upper stream of the intake port 3. An evaporated fuel processing control system 20 is installed between a fuel tank 13 and the intake pipe 8 of the engine 1.

The control system 20 has a configuration that an upper space 13*a* keeping the evaporated fuel in the tank 13 is connected with a canister 22 having an air introducing port 22*a* through an evaporation pipe 21, and a two-way-type valve 23 is installed in the evaporated pipe 21 in the manner of introducing and soaking the evaporated fuel in and to the canister 22 by a pressure difference during stopping and operating the engine 1. A pressure control valve 24 is installed in parallel with the two-way-type valve 23 for controlling a pressure in the fuel tank 13. The canister 22 is connected with a lower stream of the throttle valve 9 of the intake pipe 8 through a purge pipe 25 and purges the evaporated fuel with the air by a negative pressure of the intake pipe 8. The purge pipe 25 has a purge control valve 26 to control a purge flow amount.

An electronic control system comprises an air flow meter 14 for detecting an intake air quantity, a throttle opening degree-sensor 15 for detecting an opening degree of the throttle valve 9, an oxygen sensor 16 for detecting an air-fuel ratio, and a control unit 30 for receiving signals from various sensors. The control unit 30 outputs signals of a fuel injection quantity and an injection timing to the injector 10. A pressure sensor 27 is installed in the fuel tank 13 for detecting a pressure in an upper space 13*a* and inputs a sensor signal to the control unit 30 which outputs a signal for opening and closing the evaporation pipe 21 to the pressure control valve 24 and a signal for controlling a purge flow quantity to the purge control valve 26.

Figure 3:
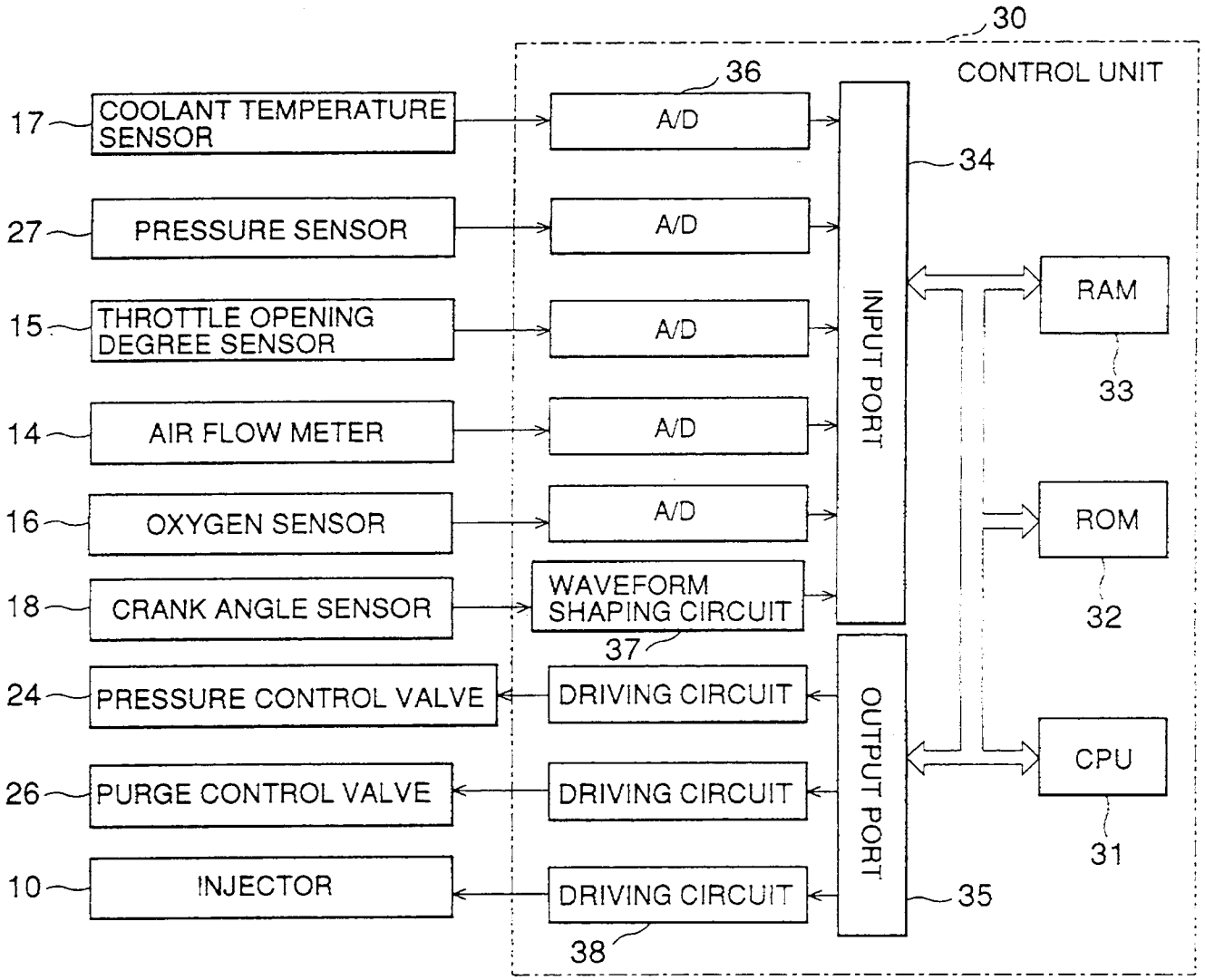
FIG. 3 is a block diagram showing a schematic configuration of the control system.

The control unit 30, as shown in FIG. 3, is comprised of a microcomputer in which a central processing unit (CPU) 31, a read only memory (ROM) 32, a random access memory (RAM) 33, an input port 34 and an output port 33 are interconnected by a bus line. The input port 34 receives through an analog/digital (A/D) converter 36 signals from a coolant temperature sensor 17, the pressure sensor 27, the throttle opening degree sensor 15, the air flow meter 14, and the oxygen sensor 16. A signal from a crank angle sensor 18 is supplied through a waveform shaping circuit 37 to the input port 34. On the other hand, an output signal of the output port 35 is outputted through a driving circuit 38 to the injector 10, the pressure control valve 24 and the purge control valve 26.

The pressure control valve 24 is closed by an OFF signal and opens by an ON signal. The purge control valve 26 is comprised of a duty solenoid valve or the like, in which an opening degree changes from a full closed state to a full open state to control a purge flow quantity in accordance with a change of a duty ratio from 0% to 100%.

Figure 4:
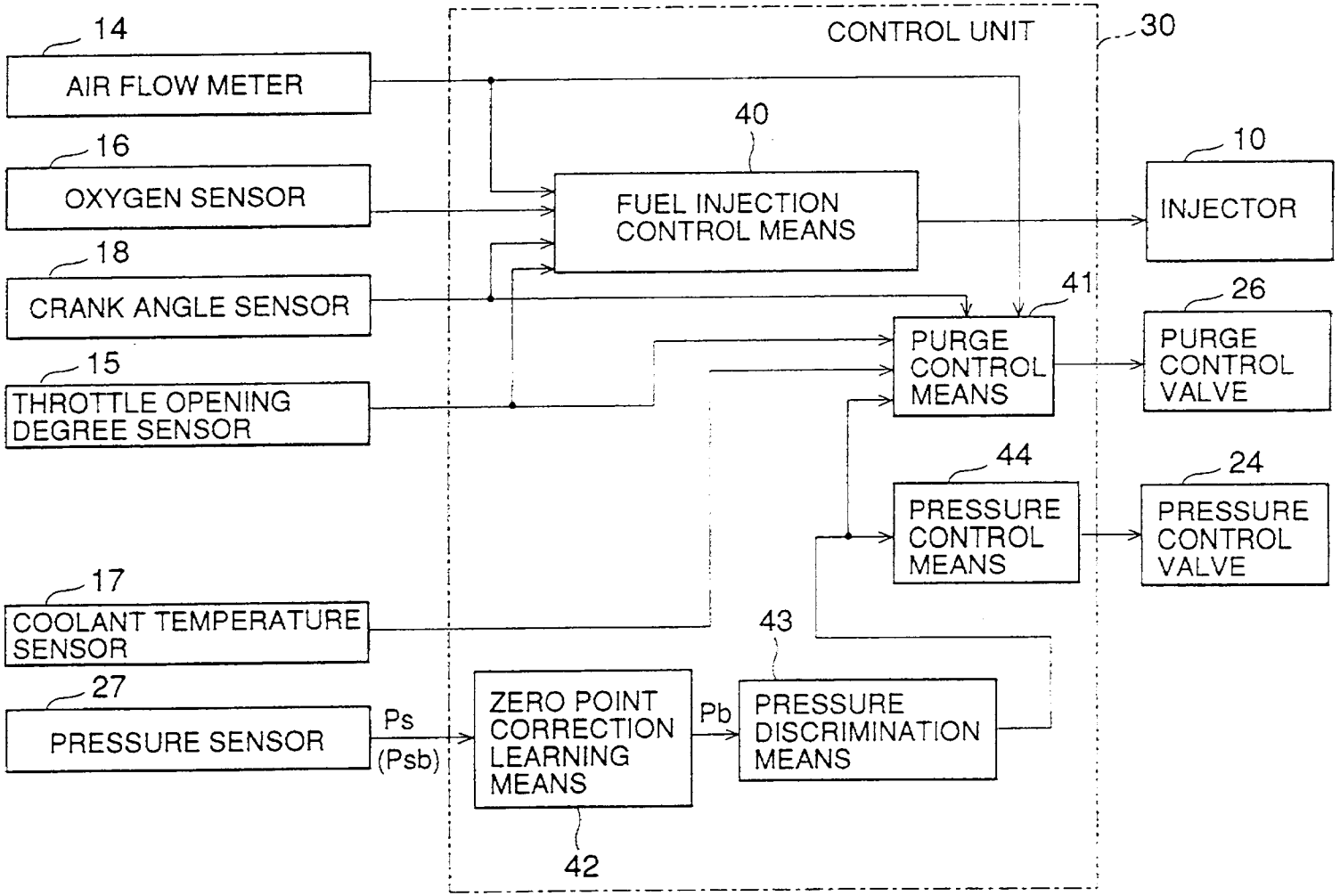
FIG. 4 is a block diagram showing a control unit.
Figure 5:
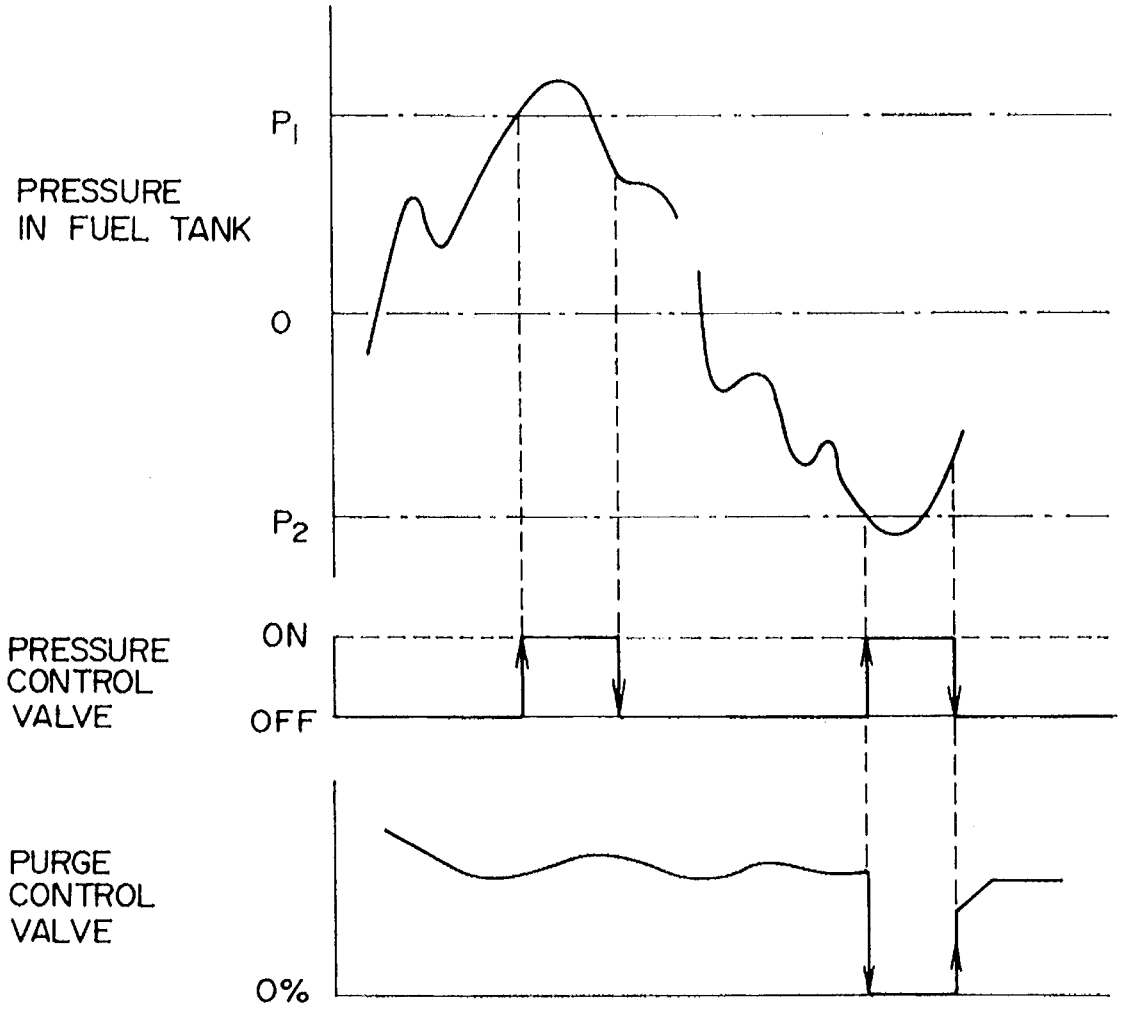
FIG. 5 is an explaining diagram showing a valve operation condition at a pressure return control of the fuel tank.

FIG. 4 is a function block diagram of the control unit 30. In the figure, the control unit 30 comprises fuel injection control means 40 as a fuel injection control system for receiving an intake air quantity signal from the air flow meter 14, a air fuel ratio signal from the oxygen sensor 16, a crank angle signal from the crank angle sensor 18, and a throttle opening degree signal from the throttle opening degree sensor 15, and for determining an injection timing in dependency on operation and running condition to output an injection timing signal to the injector 10. The control unit further comprises purge control means 41 as an evaporated fuel processing control system for receiving the intake air quantity signal from the air flow meter 14, the crank angle signal from the crank angle sensor 18, the throttle opening degree signal from the throttle opening degree sensor 15, and a coolant temperature signal from a coolant temperature sensor 17, and for determining a duty ratio in the manner that the air fuel ratio of a mixture in each operation condition is not influenced when the throttle valve 9 opens wider than the idle opening degree after warming up during operating the engine, thereby outputting a duty ratio signal to the purge control valve 26.

The control unit 30 comprises zero point correction learning means 42 as a pressure return control system for returning a pressure in the fuel tank 13, which receives an output value Ps in dependency on the pressure from the pressure sensor 27. As will be described later, the fuel tank 13 is forcibly to be a negative pressure under a predetermined condition at the initial time when the zero point correction is not performed at all, and thereafter becomes to substantially be the atmospheric pressure by introducing the air to learn in the manner of setting an output value Psb at this time to a zero point Po. On or after the second time, a learning is performed in the manner that the zero point Po is further corrected by introducing the air after detecting the condition where the fuel tank 13 becomes to a negative pressure. The output value Ps of the sensor is corrected by the zero point Po to output the pressure Pb as the pressure value in the fuel tank.

The pressure Pb is supplied to pressure discrimination means 43 to determine the pressure condition in the fuel tank. The pressure determination means 43 previously sets a first set value P1 (for example, 1500 Pa) having a hysteresis on a positive pressure to the air pressure, and a second set value P2 (for example, −1500 Pa) having a hysteresis on a negative pressure to the air pressure, and determines the pressure condition in the fuel tank by comparing the inner pressure Pb with the first and second set values P1 and P2. Accordingly, the inner pressure of the tank is determined to be near the air pressure when the condition is "$P2<Pb<P1$". On the other hand, the inner pressure is determined to be an over negative pressure when the condition is "$Pb\leqq P2$", and the inner pressure is determined to be an over positive pressure when the condition is "$Pb\geqq P1$".

A result of the discrimination of the inner pressure is supplied to pressure control means 44 to output to the pressure control valve 24 the OFF signal when the pressure in the tank is near the air pressure and the ON signal when the pressure in the tank is over-positive or over-negative pressure. The result is also supplied to the purge control means 41 to fully close the purge control valve 26 by outputting a signal including a duty ratio 0% only when the condition is over-negative pressure.

Next, function of this embodiment will be described. The pressure control valve 24 in the evaporated fuel processing control system 20 is closed when the engine stops, and the purge control valve 26 is also closed, thereby connecting the fuel tank 13 to the canister 22 through the two-way-type valve 23. Accordingly, the evaporated fuel much occurs in the upper space la by the outer temperature causing the fuel in the tank 13 to be evaporated, and the evaporated fuel is introduced and soaked in the canister 22 by opening the valve 23 caused by the pressure difference between an inlet port and an outlet port of the two-way-type valve 23, thereby preventing the evaporated fuel from a radiation to the air at feeding the fuel to the tank 13.

Fuel in the tank 13 is injected to the intake port 3 in dependency on the signals of the fuel injection quantity and injection timing of the injector 10 in the engine 1 during operation, and a mixture of the fuel and the intake air is combusted in the combustion chamber 2. At this time, the pressure condition in the fuel tank 13 is determined by detecting the inner pressure by the pressure sensor 27, and the pressure control valve 24 is closed by the OFF signal when the pressure is near the atmospheric pressure. Furthermore, the purge control valve 26 opens with the predetermined opening degree by the duty signal when the throttle valve 9 opens wider than the idle opening degree after warming the engine up. Therefore, a negative pressure in the intake pipe influences the canister 22 to purge the evaporated fuel soaked by the canister 22 with the air to the intake system, thereby combusting the evaporated fuel with the mixture.

On the other hand, the inner pressure in the fuel tank 13 changes by various conditions while the vehicle is running by operating the engine. For example, much evaporated fuel occurs in the fuel tank 13 by a traffic congestion during a long time, and the pressure control valve 24 opens by the ON signal after determining the over-positive pressure when the inner pressure becomes over the first set value P1. The large amount of evaporated fuel in one time is controlled to be taken out the fuel tank 13 through the pressure control valve 24 to the canister 22, thereby decreasing and returning the inner pressure in the tank 13 to be near the atmospheric pressure to prevent the evaporated fuel from the air radiation during feeding the fuel to the tank On the contrary, the inner pressure decreases under the second set value P2 when the vehicle is running from a high land to a level land. In this case, the pressure control valve 24 opens by the ON signal after determining the over-negative pressure in the tank 13, and at the same time, the purge control valve 26 is fully closed by the duty ratio 0%. Accordingly, the purge is forcibly stopped, and the air is introduced from the air introducing port 22*a* of the canister 22 only to the fuel tank 13 through the pressure control valve 24, thereby increasing the inner pressure in the fuel tank 13. Therefore, the pressure in the fuel tank 13 increases and returns to be near the air pressure in this case, thereby preventing the tank from the injury.

Next, there will be described a zero point correction learning control of the pressure sensor 27. The zero point correction learning control performs the initial learning when the zero point correction of the pressure sensor 27 is not performed at all, and performs the on or after second learning after the zero point correction is performed at least one time.

Figure 6:
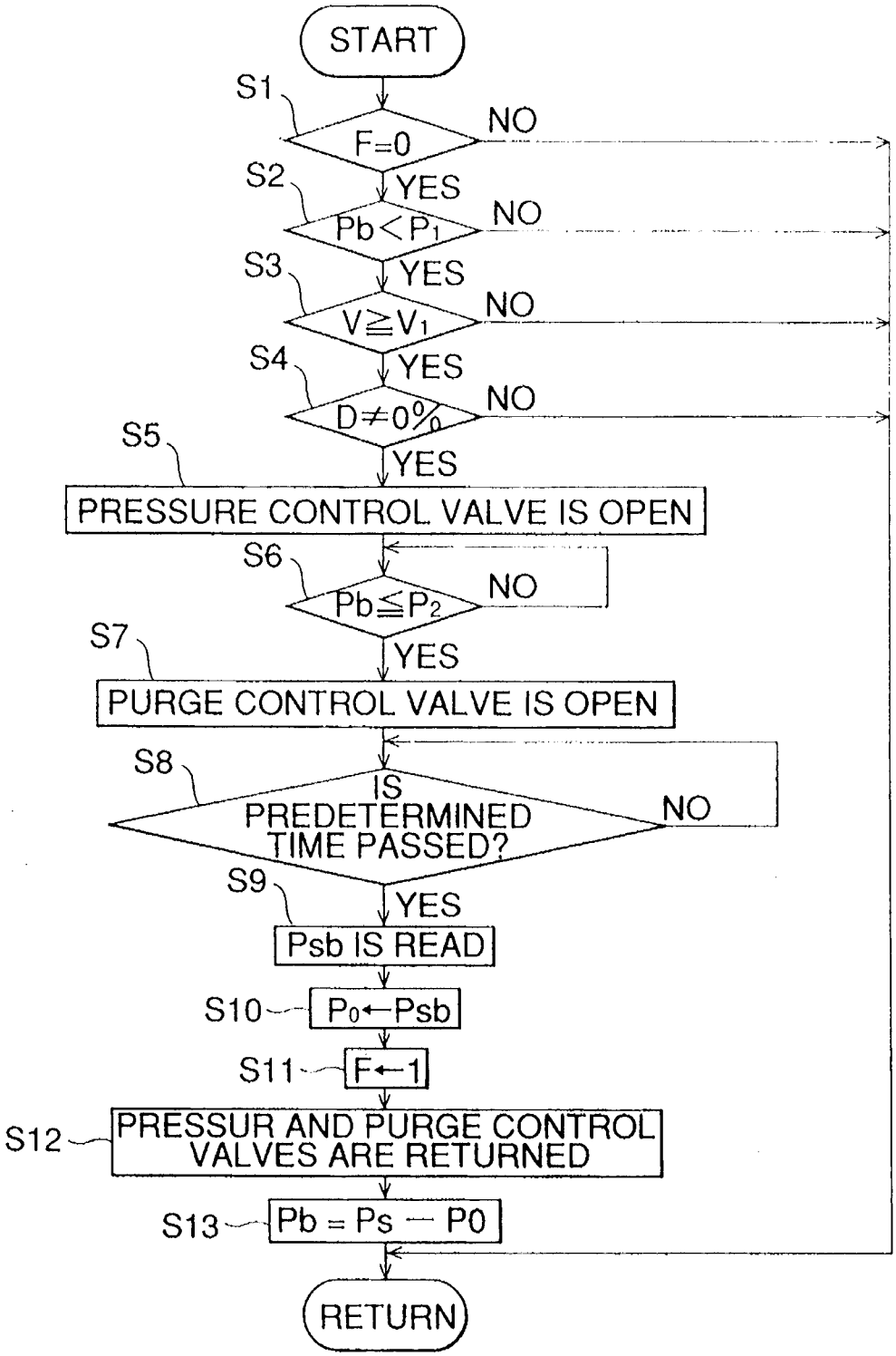
FIG. 6 is a flow chart showing an initial learning control of a zero-point correction of the pressure sensor.
Figure 7:
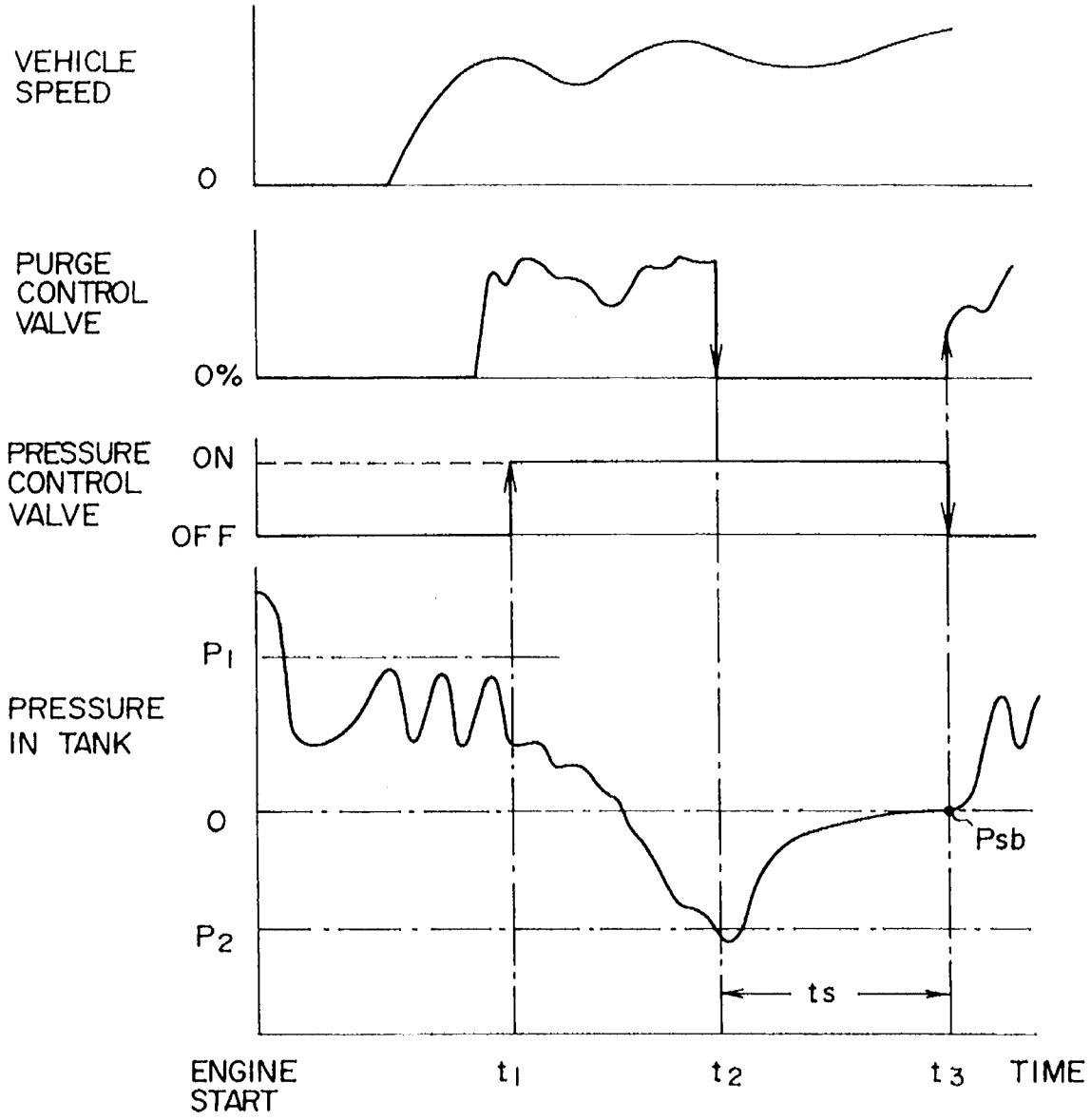
FIG. 7 is a time chart showing the learning control shown in FIG. 6.

The zero point correction control at the initial learning is described by flow and time charts respectively shown in FIGS. 6 and 7. At step S1, a learning flag F is referred. The learning flag F is set to "F=0" in the case where the zero point correction has not yet performed and the case where the control unit 30 is reset by a battery change or the like. The flag is set to "F=1" after the initial learning, and a back-up RAM keeps the condition to "F=1" when the engine stops. Accordingly, when the initial learning is performed under the condition of "F=1", the operation terminates. The operation for the initial learning under the condition of "F=0", advances to a step S2 to refer the inner pressure condition in the fuel tank 13 after a predetermined time at starting the engine. Accordingly, the inner pressure Pb is compared with the first set value P1 on the positive pressure side in a pressure return control, and the operations terminate when the pressure is "Pb≧P1".

Operation advances to a step S3 to refer a vehicle velocity V when the inner pressure is near the atmospheric pressure under "Pb<P1", further advances to a step S4 to refer the duty ratio D of the purge control valve 26 while the vehicle in running under the velocity V over a set velocity V1 (for example, 30 km/h), and to a step S5 during purging of "D≠0" %. Accordingly, the initial learning condition is established at a time point t1 in FIG. 7 under three cases satisfying conditions during normal running after starting the engine, while the pressure in the tank 13 is near the atmospheric pressure, and during purging the tank. The pressure control valve 24 opens by the ON signal at the step S5 when the learning condition is established. The negative pressure in the intake pipe during purging influences to the fuel tank 13 through the pressure control valve 24. Since the fuel tank 13 is forcibly to be a negative pressure, the inner pressure Pb rapidly decreases as shown in FIG. 7.

Then, advancing to a step S6, the inner pressure Pb is compared with the second set value P2 on the side of the negative pressure in the case of the inner pressure return control. Advancing to a step S7, the purge control is interrupted by fully closing the purge control valve 26 when the pressure is "Pb≦P2" at a time point t2 shown in FIG. 7, and an interrupted condition is kept during a predetermined time period ts in a step S8. Accordingly, the inner pressure control is the same as the case where the fuel tank 13 becomes the over-negative pressure, and the air is introduced from the air introducing port 22*a* of the canister 22 through the pressure control valve 24 only to the fuel tank 13, thereby rapidly increasing and returning the inner pressure Pb after the time point t2 as shown in FIG. 7.

The pressure Pb in the fuel tank 13 properly becomes to substantially the air at a time point t3 after the predetermined time period ts. At this time, operation advances from a step S8 to a step S9 to read an output value Psb of the pressure sensor 27 so as to store the output value Psb of the sensor as a zero point Po in a step S10. Advancing to a step S11, a learning flag F is set to "F=1", and the pressure control valve 24 and the purge control valve 26 are returned to the normal control at a step S12, thereby completing the initial learning to return an original purge control condition. In a step S13 after that, the inner pressure Pb is corrected to be "Pb=Ps−Po" against the output value Ps of the pressure sensor 27, thereby increasing a detection accuracy of the pressure sensor 27.

As described above, when the inner pressure in the fuel tank 13 is lower than P1, the fuel tank is caused during the normal running forcibly to be a negative pressure once in the case of the purge control at the initial learning, and the inner pressure control causes the fuel tank 13 to rapidly and properly be substantially the air pressure, thereby setting and storing the zero point Po in the high accuracy. Therefore, it is possible to properly eliminate a discrepancy of the parts in the pressure sensor 27 and a change of the sensor output caused by the change with lapse of time, and the detection accuracy of the pressure sensor 27 becomes high, thereby performing the pressure return control of the fuel tank in a high accuracy.

Figure 8:
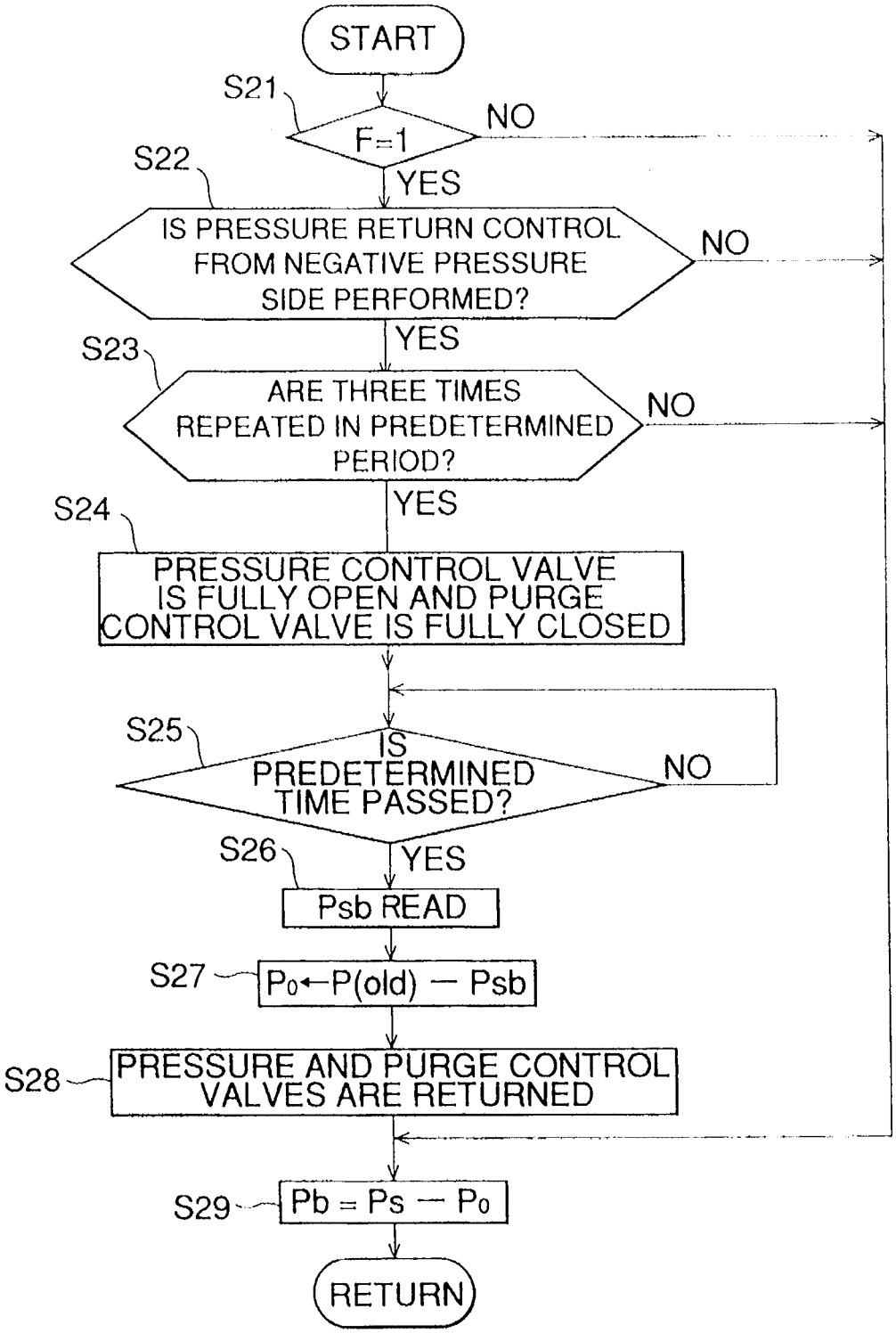
FIG. 8 is a flow chart showing a learning control after second time of the zero-point correction of the pressure sensor.
Figure 9:
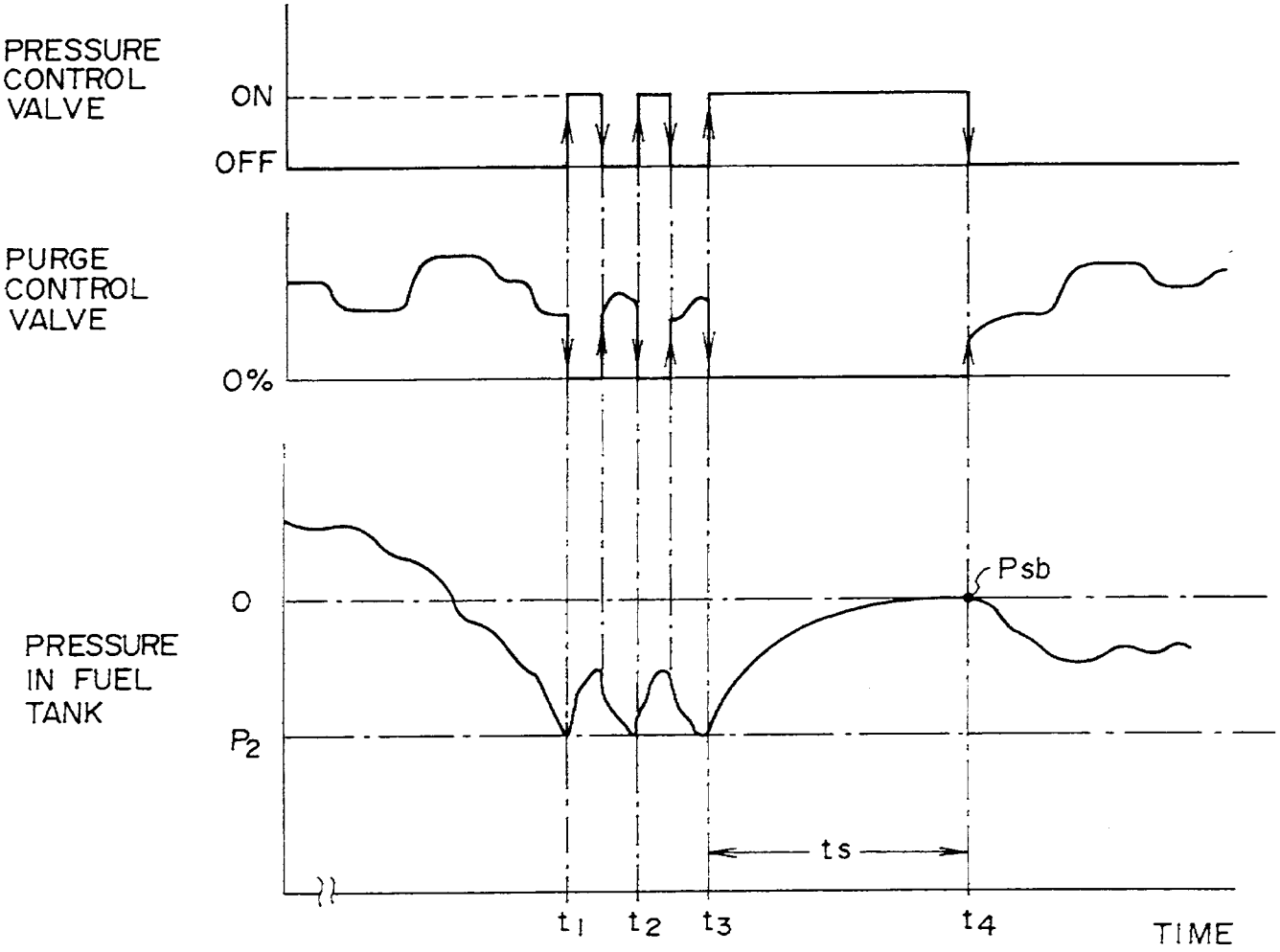
FIG. 9 is a time chart showing the learning control shown in FIG. 8.

There will be described a zero point correction control on or after a second learning by referring to a flow chart shown in FIG. 8 and a timing chart shown in FIG. 9. A learning flag F is referred in a step S21, and operation advances to a step S22 by a condition of "F=1" when the initial learning has already performed to determine as to whether there is a presence or absence of the pressure return control about the over-negative pressure caused by the pressure of the fuel tank 13. Operation advances to a step of "return" in FIG. 8 when the pressure return control is absent. The presence of the pressure return control causes operation to advance to a step S23 to determine as to whether or not a predetermined times (for example, three times) are repeated within a predetermined time, and operation is terminated when the pressure return control is only one time such as a fluid surface change caused by a sharp turn of the vehicle. On the other hand, the learning condition is established after determining that the frequencies of the negative pressure in the fuel tank 13 is high because the air pressure change is large by sharply moving the vehicle from the high land to the level land when the pressure return control from the negative pressure is repeated in the three times such as the time points t1, t2 and t3 shown in FIG. 9. In this case, operation advances from a step S23 to a step S24 at the third time point t3, and the pressure control valve 24 opens and the purge control valve 26 is fully closed. This condition is kept during the predetermined time ts in a step S25. Therefore, the air is introduced from the air introducing port 22*a* of the canister 22 through the pressure control valve 24 only to the fuel tank 13 to rapidly return the inner pressure Pb after the time point t3 shown in FIG. 9, thereby properly performing the normal inner pressure return control.

The pressure Pb in the fuel tank 13 is certainly to be the atmospheric pressure at the time point t4 after passing the predetermined time ts, and operation advances from the step S25 to a step S26 to read an output value Psb of the pressure sensor 27 in this case. Operation advances to a step S27 to correct and store the present zero point Po in the manner of the equation "Po=Po(old)−Psb" in dependency on the sensor output value Psb and the previous zero point Po (old) which has been already set. The pressure control valve 24 and the purge control valve 26 are returned to the normal control in a step S28, thereby completing the learning on or after the second times and returning the original purge control condition. Then, the pressure Pb is corrected against the output value Ps of the pressure sensor 27 in dependency on the equation of "Pb=Ps−Po" in a step S29. The learning control is performed in the manner that the zero point Po is renewed by repeating twice, thrice, . . . , each establishment of the learning condition described as above.

In learning on or after the second one as described above, the fuel tank 13 is detected to be in several condition of the certain negative pressure, and the zero point Po is repeatedly corrected in dependency on the substantial air pressure caused by the inner pressure return control at each negative pressure condition. Therefore, a learning is performed in the manner that an accuracy of the zero point correction becomes higher and higher, thereby increasing the detection accuracy for the pressure in the fuel tank 13.

The present invention can be applied to the case where a signal for a pressure in a fuel tank is detected by a pressure sensor to use in a control without the pressure return control. Another configuration of the present invention may be applied to the case where an air pressure change over valve is provided in the pipe between the fuel tank and the pressure sensor, and performs a zero point correction after the pressure sensor directly measures the atmospheric pressure. Furthermore, it is possible to return a normal control after interrupting a learning control in the case where the internal pressure becomes over a predetermined range during a learning control of the zero point correction.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An evaporating fuel control system mounted on a motor vehicle having, a fuel tank, a pressure sensor for detecting a pressure in an upper space of the fuel tank, a canister for soaking an evaporated fuel occurring in the fuel tank, purge means for purging the evaporated fuel to an engine intake system while an engine is driving; comprising learning discrimination means for discriminating whether a zero-point correction of the pressure sensor is performed at least one time or not;

learning condition determining means for determining an establishment of a learning condition when the pressure is near an atmospheric pressure and when said vehicle is normally running after starting said engine during a purge when the zero-point correction of the pressure sensor is inoperative at least one time;

air pressure returning means for causing the upper space of the fuel tank to be a negative pressure during said purge and for opening the negative pressure to an atmospheric pressure;

zero point setting means for deciding a zero point of an output value of the pressure sensor after a predetermined time while opening to the air; and correction means for correcting the output value of the pressure sensor in dependency on the zero point so as to improve a detection accuracy.

2. The evaporated fuel processing control means according to claim 1; comprising air pressure returning means for first causing the fuel tank to be a negative pressure by opening a pressure control valve installed in an evaporation pipe connecting the fuel tank with the canister while opening a purge control valve installed in a purge pipe connecting the canister with an intake system and for second introducing an atmospheric air from the canister to the fuel tank by fully closing the purge control valve, thereby returning the pressure in the tank to substantially the air pressure after the predetermined time.

3. An evaporating fuel control means mounted on a vehicle having, a fuel tank, a pressure sensor for detecting a pressure in an upper space of the fuel tank, a canister for soaking an evaporated fuel occurring in the fuel tank, purge means for purging the evaporated fuel to an engine intake system while an engine is driving; comprising learning discrimination means for discriminating whether a zero point correction of the pressure sensor is twice after an initial correction is performed or not;

learning condition determination means for determining an establishment of a learning condition when the fuel tank satisfies a condition to be a negative pressure by repeating a plurality of processing to be negative pressure within a predetermined time in the case of the correction after two times;

air pressure returning means for opening the upper space of the fuel tank to the air when the learning condition is established;

zero point setting means for renewing a previous zero point by the output value of the pressure sensor after a predetermined time when opening said upper space to the air; and correction means for correcting the output value of the pressure sensor by a renewed zero point so as to improve a detection accuracy.

4. The evaporated fuel processing control means according to claim 3; comprising at least air pressure returning means for first causing the fuel tank to be a negative pressure by opening a pressure control valve installed in an evaporation pipe connecting the fuel tank with the canister under a condition of opening a purge control valve installed in a purge pipe connecting the canister with an intake system and for second introducing said atmospheric air from the canister to the fuel tank by fully closing the purge control valve, thereby returning the pressure in the tank to the atmospheric pressure after the predetermined time.

* * * * *